US005297617A

United States Patent [19]

Herbert

[11] Patent Number: 5,297,617

[45] Date of Patent: Mar. 29, 1994

[54] FAN ASSEMBLY WITH HEAT SINK

[76] Inventor: Edward Herbert, 1 Dyer Cemetery Rd., Canton, Conn. 06019-2029

[21] Appl. No.: 994,671

[22] Filed: Dec. 22, 1992

[51] Int. Cl.[5] ..... F28F 13/12

[52] U.S. Cl. ..... 165/80.3; 165/125; 361/697

[58] Field of Search ..... 165/80.3, 121, 125, 165/109.1; 361/383, 384; 415/177

[56] References Cited

U.S. PATENT DOCUMENTS

| | | | |
|---|---|---|---|
| 1,884,094 | 10/1932 | Modine | 165/109.1 |
| 2,162,152 | 6/1939 | Wulle | 165/125 |
| 2,368,732 | 2/1945 | Wallgren | 165/125 |
| 3,285,328 | 11/1966 | Woodward | 165/121 |
| 3,545,890 | 12/1970 | Hubbard et al. | 415/177 |
| 3,844,341 | 10/1974 | Bimshas, Jr. et al. | 165/86 |
| 4,034,204 | 7/1977 | Windsor et al. | 165/125 |
| 4,513,812 | 4/1985 | Papst et al. | 361/384 |
| 5,000,254 | 3/1991 | Williams | 165/80.3 |
| 5,079,438 | 1/1992 | Heung | 361/384 |

FOREIGN PATENT DOCUMENTS

| | | | |
|---|---|---|---|
| 534254 | 10/1955 | Italy | 415/177 |
| 211700 | 8/1990 | Japan | 361/384 |

OTHER PUBLICATIONS

Hardin, P. W., "Integral Edge Connector", IBM Technical Disclosure Bulletin, vol. 20, No. 11A, Apr. 1978, pp. 4346–4348.

*Primary Examiner*—John Rivell
*Assistant Examiner*—L. R. Leo

[57] ABSTRACT

Heat transfer from the inside of a fan duct to the air is very good because the air in this region has a high velocity and is turbulent due to the rotation of the fan blades. Devices mounted on the outside of the fan duct can thus be cooled effectively. The inside surface of the duct can be modified to enhance the heat transfer as by grooving it deeply. The fan blade also can be modified to increase the air velocity and the turbulence. External fins can be added to the fan duct, and it can be shrouded so that a portion of the exit air passes through the fins back to the inlet. This decreases the mass of the exit air, for quieter operation. In a multi-stage fan, inlet, outlet and interstage fins can be used to further enhance the heat flow to the air.

10 Claims, 10 Drawing Sheets

FAN ASSEMBLY WITH HEAT SINK

BACKGROUND OF THE INVENTION

This invention relates to fan and heat sink assemblies as might be used for heat sinking semiconductor devices. Usually a fan is mounted so that it blows air over a heat sink assembly. The rate at which heat can be removed from the heat sink is a function of the heat sink surface area, the temperature difference from the heat sink to the air, and the velocity of the air. If the air has high velocity and is turbulent, the heat sink can be relatively smaller, but there are limitations to the extent that this is practical. It takes a large, powerful fan to move air with a high velocity. Such a fan would be expensive, would take substantial power to operate, and would be large and noisy.

This invention teaches that there is a region within a ducted fan where the air naturally has a very high velocity and is turbulent the inside surface of the fan duct in the area swept by the fan blades. The fan blades move the air very rapidly, and also generate blade tip vortices and wake turbulence, so heat flow into the air stream is greatly enhanced. By mounting semiconductors or other devices needing heat sinking on the outside of the fan duct and in good thermal contact with it, a superior heat sink is achieved.

This invention further teaches several modifications to the inside surface of the fan duct and/or the fan blades to further enhance heat flow through the fan duct as a trade-off with fan performance as an axial flow device. In some embodiments, axial air flow from the fan assembly is entirely eliminated in favor of maximally enhancing heat transfer within the fan assembly.

Often the amount of air needed to transport the waste heat away from a heat sink is small compared to the amount of air that is needed to sustain sufficient air velocity for good heat transfer. Several embodiments of the invention teach that much of the air flow can be recirculated within the fan assembly with heat sink to provide high air flow internally across the heat transfer surfaces. The inlet and exit air flow is then quite low, which will make operation much quieter, and greatly reduce the design requirements of accessories such as filters and finger guards which may be required on the inlet and/or outlet.

In a vane axial fan, the inlet and/or outlet vanes can also serve as heat transfer surfaces. In a multi-stage fan, the baffles or flow straighteners between the fan stages can also serve as heat transfer surfaces. These features can be optimized for heat transfer as a trade off with maximum fan performance in the usual sense.

DESCRIPTION OF THE PREFERRED EMBODIMENTS

Figure 2:
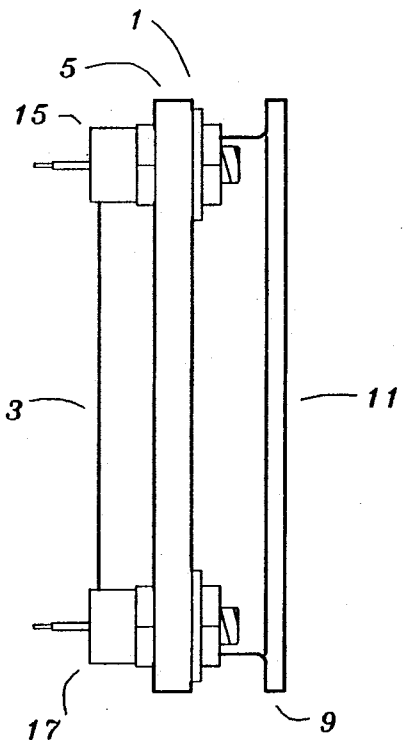
FIG. 2 is a side view of the fan of FIG. 1.
Figure 1:
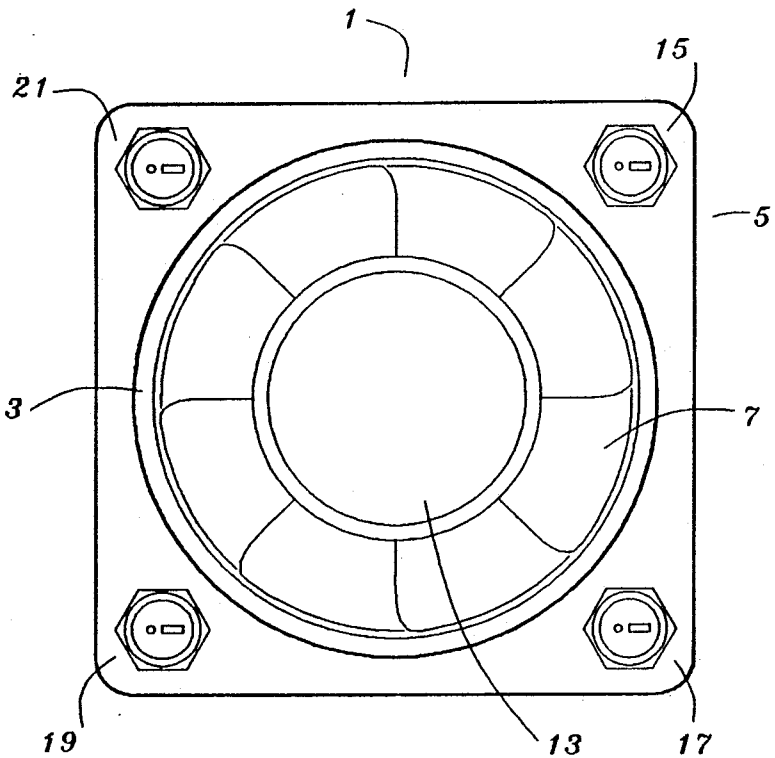
FIG. 1 shows an axial fan assembly of otherwise ordinary construction having a heat sink mounting flange for semiconductors. The heat sink mounting flange has a good thermal path to the inside surface of the fan duct where heat transfer to the air is enhanced by the high velocity and the turbulence of the air in the vicinity of the fan blade tips.

FIGS. 1 and 2 show a front view and a side view of a fan assembly 1. A fan 7 rotates within a fan duct 3 causing axial flow of air. A heat sink flange 5 for semiconductors 15, 17, 19, 21 is an integral part of, and an extension of the fan duct 3, and is preferably fabricated as by casting of a material having good thermal conductivity, such as aluminum. Mounting for the fan assembly 1 may be by a mounting flange 9. In many respects, the fan assembly 1 is an ordinary axial fan. The means by which the fan 7 is rotated is not material to the invention, but it may comprise a motor 11 (hidden) which may be located inside the hub 13 of the fan 7.

Heat from the semiconductors 15, 17, 19, 21 is conducted into the heat sink flange 5 and thence into the fan duct 3. The heat will then pass into the ambient air and surroundings by convection and radiation, to an extent, but heat transfer to the air is particularly effective at the inside surface of the fan duct 3 in the vicinity of the blade tips of the fan 7.

It is well known to those skilled in the art that the flow of heat from a heat sink to the ambient air is poor. The temperature of the air immediately adjacent to the heat sink rises rapidly nearly to the temperature of the heat sink surface, and tends to form a stagnant layer or boundary layer which tends to insulate the heat sink. This insulating effect is reduced if a fan is used to move the air over the heat sink. Heat flow into the air improves as the air velocity is increased, particularly when the velocity is high enough so that the air flow becomes turbulent.

The heat flow continues to improve as the velocity of the air is increased, but there are practical limits to which the air velocity can be increased in most applications. Large, powerful fans are expensive to acquire and operate, and tend to be very noisy. Thus for most applications a smaller quieter fan will be used, and the poorer heat conduction into the lower velocity air will be compensated for by using a larger heat sink.

There is a region in an axial flow ducted fan where the air flow has a very high velocity and is turbulent: the inside surface of the fan duct in the vicinity of the blade tips of the fan. As the fan rotates at a high speed, the air in the area swept by the blade tips of the fan will have a very high velocity and further will have a very complex flow due to blade tip vortices and so forth. As a consequence of this high velocity, turbulent air flow, heat conduction into the air is much enhanced in this region, and this phenomenon can be used to make an improved heat sink.

In the fan assembly of FIG. 1, heat sinking of the semiconductors 15, 17, 19, 21 is achieved through a simple modification of the fan duct 3 by adding the heat sink flange 5. This will result in some very marginal heating of the air as it passes through the fan 7, but otherwise the fan characteristics and performance are unaffected. The heat sink flange 5 is preferably integral to the fan duct 3, but it need not be. It could be provided as a separate accessory to be mounted as required. In this way, a variety of heat sink flanges could be offered or custom fabricated, and the mounting orientation could be varied for different applications. The inside surface of the fan duct 3 preferably is not coated with paint or any other material which would be an insulator.

The use of a heat sink flange 5 itself is not necessary to the teachings of the invention but is used as a general illustration. Any mounting means for any device which needs heat sinking which can be made integral to or attached to the fan duct and provide heat conduction from the device to the inside surface of the fan duct would be the functional equivalent of the heat sink flange 5. Heat flow can also be in the other direction, as for instance, to transfer heat from the air into the evaporator of a heat pump.

Figure 4:
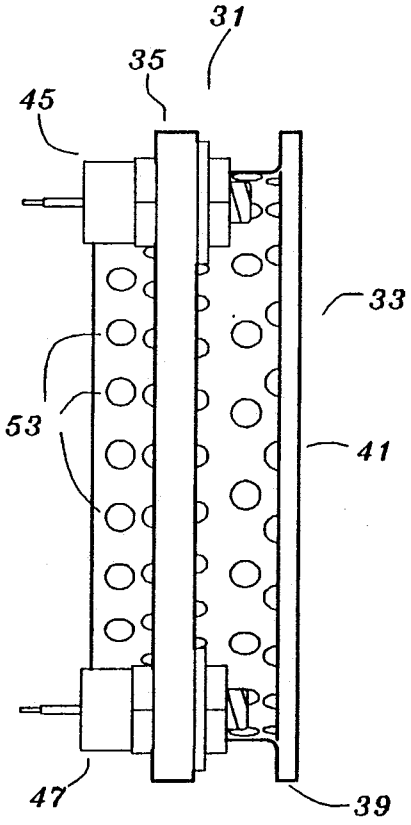
FIG. 4 is a side view of the fan of FIG. 3.
Figure 3:
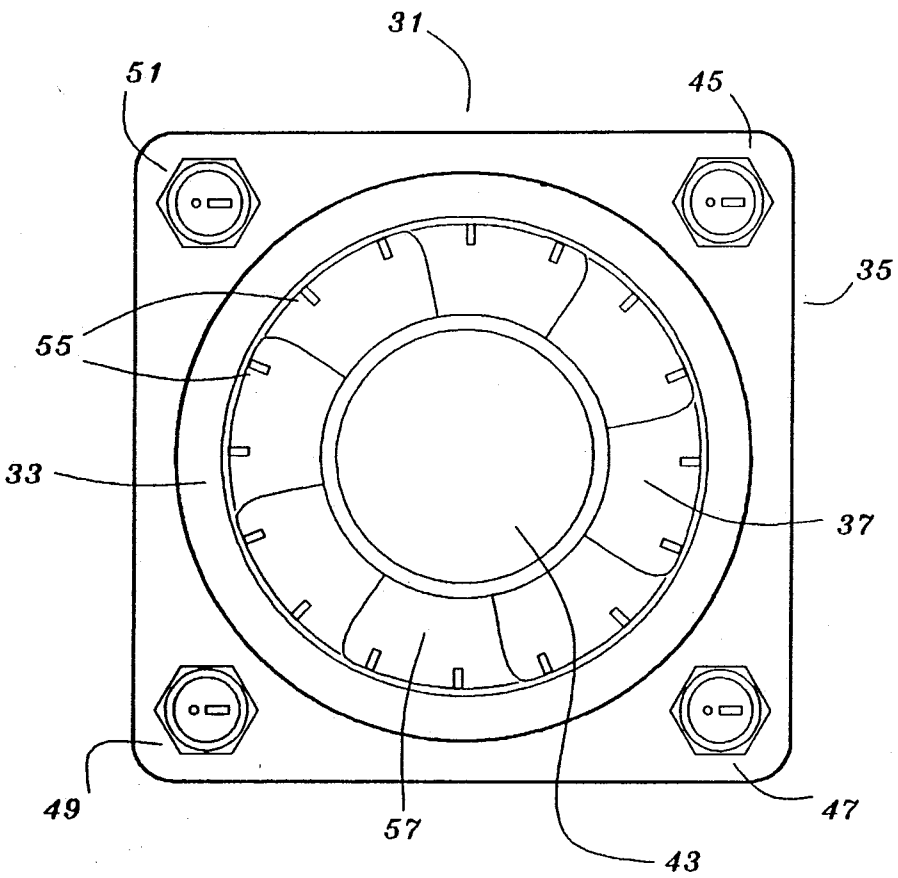
FIG. 3 is similar to the fan assembly of FIG. 1, but has a thickened duct wall to allow for features to enhance heat transfer to the air, and has modified fan blades.

FIGS. 3 through 10 and 24 show other embodiments of a fan assembly. FIGS. 3 and 4 show a front and a side view of a fan assembly 31. In many respects, the fan assembly 31 of FIGS. 3 through 10 is similar to the fan assembly 1 of FIGS. 1 and 2. One difference is that the casting for the fan duct 33 in FIG. 3 is considerably thicker than the casting for the fan duct 3 in FIG. 1. This is to provide extra material so that the inside surface of the fan duct 33 can be modified to enhance heat flow into the air stream, as shown in FIGS. 5 through 10. Another difference is that the fan 37 may be modified by the addition of paddle bars 55, 55 which are added to the tips of the blades 57 parallel to the axis of the fan assembly. The paddle bars 55, 55 further agitate the air stream in the vicinity of the inside surface of the fan duct 33 to further enhance the heat transfer from the fan duct 33 to the air stream. The paddle bars 55, 55 may be straight as shown, or could be contoured as air foils. Another difference is that a plurality of holes 53, 53 may be provided through the fan duct 33. The holes 53, 53 may be radial as shown, or they may be tangential. The holes 53, 53 are preferably staggered, and carefully located with respect to each other and the fan blades 57 and paddle bars 55, 55 so that acoustic noise is cancelled or at least not reinforced, so that a siren is not made inadvertently.

In FIGS. 3 and 4, semiconductors 45, 47, 49, 51 are mounted on a heat sink flange 35 which is an integral part of the fan duct 33. A fan 37 rotates within the fan duct 33. The fan 37 may be driven by a motor 41 (hidden) which may be located inside the hub 43 of the fan 37. A mounting flange 39 may be used to mount the fan assembly 31.

Figure 5:
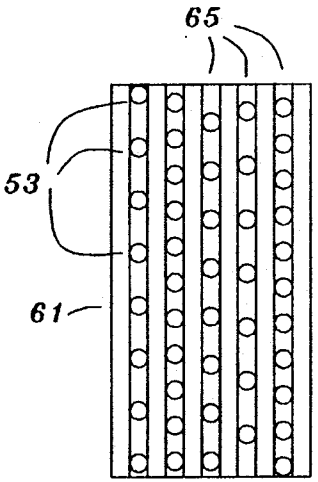
FIG. 5 is a view from the inside of the duct of one embodiment of the fan of FIG. 3 showing a segment of the inside surface of the fan duct. The fan duct has a plurality of grooves and ridges to increase the surface area for heat transfer. A plurality of holes in the fan duct further increases the surface area and provides heat transfer to air which bleeds through the holes.
Figure 6:
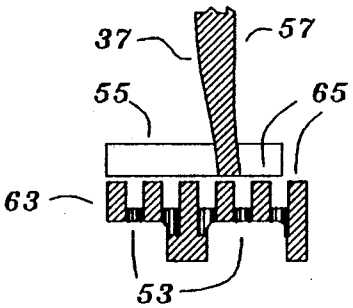
FIG. 6 shows a cross section through the fan duct segment of FIG. 5, and a cross section and side view of a modified fan blade.

FIGS. 5 and 6 show one embodiment of the fan duct 33 and fan 37. FIG. 5 is a view from inside the fan duct 33 showing a segment 61 of the inside surface of the fan duct 33. FIG. 6 shows a section 63 through the fan duct 33, a section through a fan blade 57 of the fan 37 and a side view of a paddle bar 55. A plurality of grooves and ridges 65, 65 encircle the fan duct 33 on its inside surface in the area swept by the blade tips of the fan 37. As the fan 37 rotates in the fan duct 33, high velocity and turbulent air will sweep around the inside of the fan duct 33 within the grooves and between the ridges 65, 65. The grooves and ridges 65, 65 significantly increase the surface area inside the fan duct 33 which is swept by the high velocity and turbulent air, therefore increasing the heat flow into the air stream. The paddle bars 55 further accelerate the air around the inside of the fan duct 33, performing in a manner of speaking as the blades of a centrifugal fan. The air tends to leave the paddle bars 55, 55 tangentially, but it is constrained by the fan duct 33 and tends to circulate therein. Optionally, a plurality of holes 53, 53 may penetrate the fan duct 33. The holes 53, 53 may be radial as shown, or they may be tangential to align with the natural direction of air flow leaving the paddle bars 55. The inside surface of the holes 53, 53 provides additional surface for heat transfer, and the air passing through the holes 53, 53 will have a high velocity and will be turbulent. Tangential holes would tend to be longer, and so would have more inside surface area if of equal diameter. The holes need not be round as shown, but could have a cross-section with increased surface area such as a star or snow-flake, for greater heat transfer.

Figure 24:
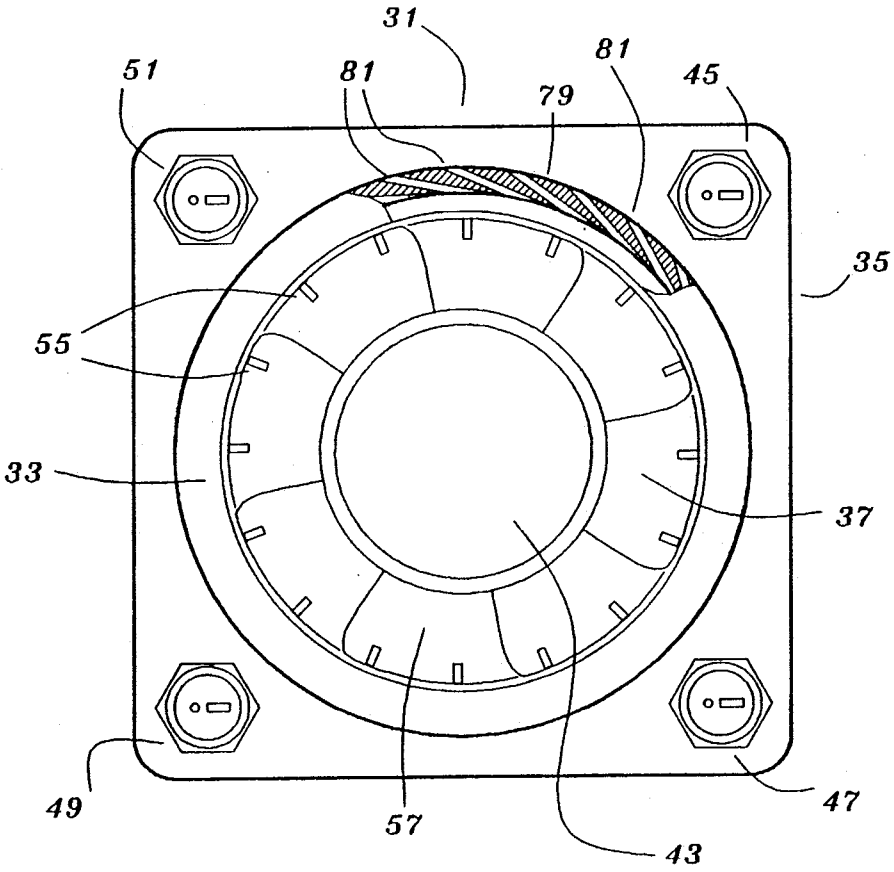
FIG. 24 shows another embodiment of the fan of FIG. 3. A partial sectioning of the fan duct shows tangential air exit holes.

FIG. 24 shows another embodiment of the fan assembly of FIG. 3. A partial section 79 of the fan duct 33 shows a plurality of holes 81, 81 through the fan duct 33. The holes 81, 81 are tangential to the fan blades 57 and the paddle bars 55, 55 for counter clockwise rotation. The internal surface of the holes 81, 81 provides additional surface for heat transfer, and the air bleeding through the holes 81, 81 will have a high velocity and will be turbulent.

Figure 7:
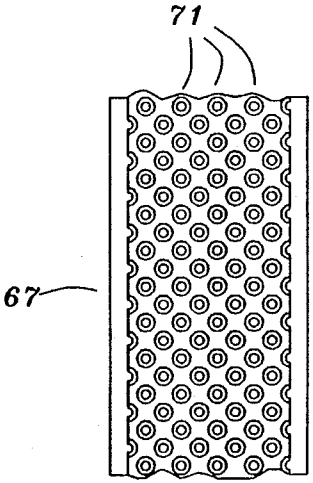
FIG. 7 is a view from the inside of the duct of another embodiment of the fan of FIG. 3 showing a segment of the inside surface of the fan duct. The fan duct has a plurality of pins to increase the surface area for heat transfer.
Figure 8:
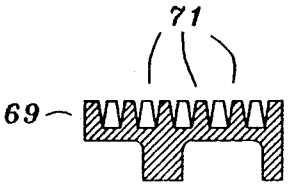
FIG. 8 shows a cross section through the fan duct segment of FIG. 7.

FIGS. 7 and 8 show another embodiment in which the inside surface of the fan duct 33 has a plurality of posts 71, 71 arranged in a dense pattern. FIG. 7 shows a segment 67 of the inside surface of the fan duct 33. FIG. 8 shows a section 69 through the fan duct 33.

Figure 9:
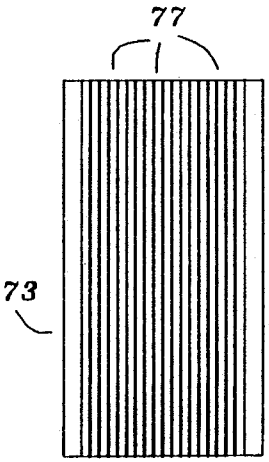
FIG. 9 is a view from the inside of the duct of another embodiment of the fan of FIG. 3 showing a segment of the inside surface of the fan duct. The fan duct has a plurality of thin fins to increase the surface area for heat transfer.
Figure 10:
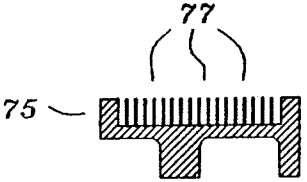
FIG. 10 shows a cross section through the fan duct segment of FIG. 9.

FIGS. 9 and 10 show another embodiment in which the inside surface of the fan duct 33 has a plurality of thin fins 77, 77 arranged to encircle the fan duct 33 on its inside surface. FIG. 9 shows a segment 73 of the inside surface of the fan duct 33. FIG. 10 shows a section 75 through the fan duct 33.

FIGS. 3 through 10 and 24 illustrate but a few of the many, many possible treatments of the inside surface of the fan duct 33 to enhance heat flow. In general, the objective is to provide more surface area to the high velocity and turbulent air at the blade tips of the fan 37, and may incorporate a variety of features to accomplish this. The pattern and arrangement of the features may increase heat flow above and beyond just the amount attributed to the increased surface area by accelerating the air or causing it to be more turbulent, or by causing it to change direction frequently so that it impinges more directly on the surface features for greater heat transfer.

Fan performance as it is usually understood will be better with a smooth inside surface of the fan duct. In improving the heat sinking capacity of the fan assembly 31, a comprise in its performance as a fan is accepted. Either the axial air flow through the fan will be reduced or the fan and motor will have to be increased in performance to compensate for the increased friction and blade tip losses. For many applications, the ability to heat sink components through the fan duct may more than compensate for any reduction in the fan performance. Not only may a separate heat sink be eliminated, resulting in a smaller, lighter, more compact package, but the reduced performance as a fan may result in lower air noise because of the reduced velocity and mass of the exit air.

Figure 12:
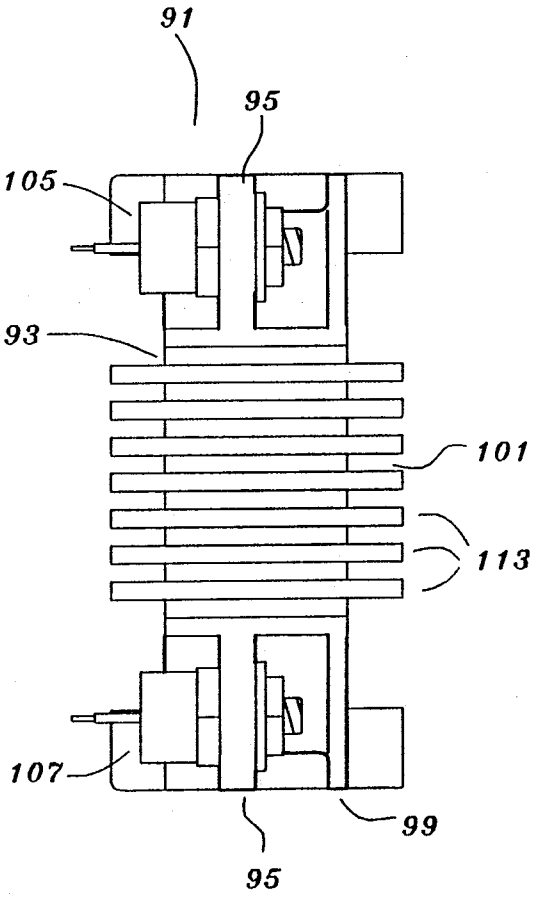
FIG. 12 is a side view of the fan of FIG. 11.
Figure 11:
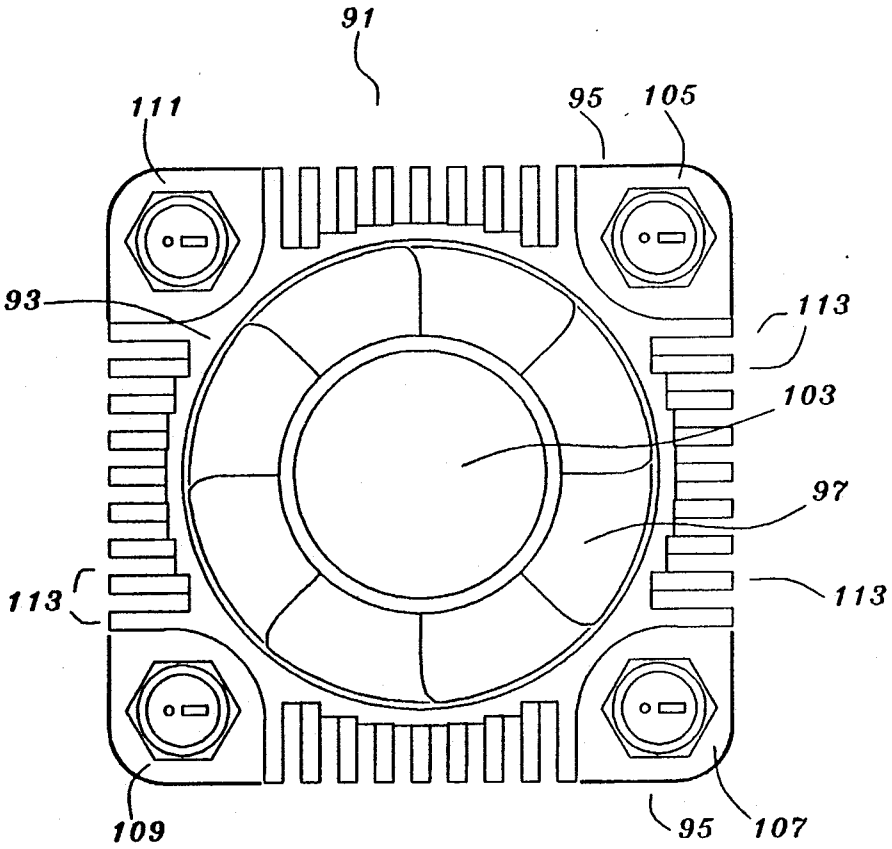
FIG. 11 is similar to the fan assembly of FIG. 1, but has a plurality of fins cast integral to the fan duct.
Figure 14:
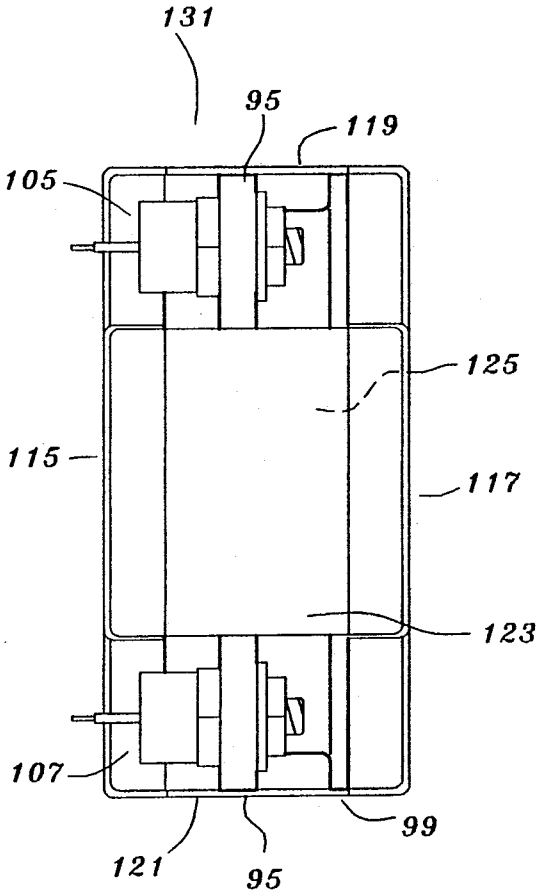
FIG. 14 is a side view of the fan of FIG. 13, showing the fins are also shrouded on the sides and the inlet side, so that a portion of the air from the fan is directed outward and back over the fins to the inlet, to increase the transfer of heat within the fan unit. The volume of the inlet and outlet air is reduced, for quieter operation.
Figure 13:
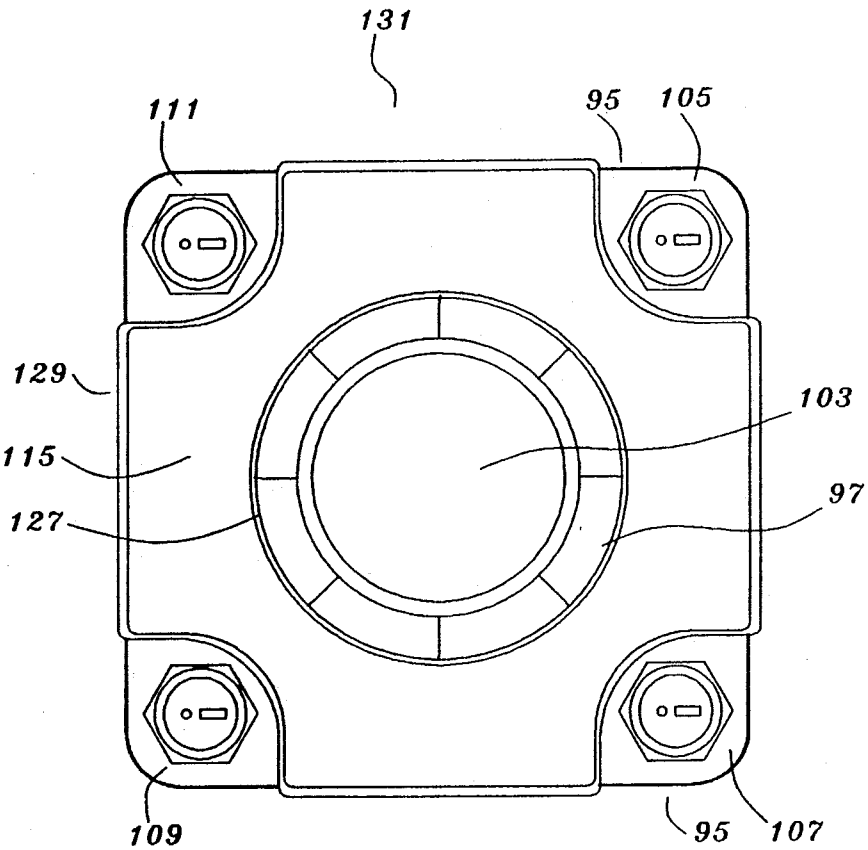
FIG. 13 is the fan of FIG. 11 having a shroud covering a portion of the fan exit, directing the air outward and back over the fins.

FIGS. 11 through 14 show another embodiment of the fan assembly. The fan sub-assembly 91 of FIGS. 11 and 12 is a sub-assembly, shown to illustrate certain internal features. The fan assembly 131 of FIGS. 13 and 14 is the fan sub-assembly 91 of FIGS. 11 and 12, but shrouded.

FIG. 11 shows a front view and FIG. 12 shows a side view of a fan sub-assembly 91 which in many respects is similar to the fan assembly 1 of FIGS. 1 and 2. A fan 97 rotates within a fan duct 93. Integral to the fan duct 93 are heat sink mounting flanges 95, 95 for mounting semiconductors 105, 107, 109, 111. The fan 97 may be driven by a motor 101 (hidden) which may be located inside the fan hub 103. The fan sub-assembly 91 may be mounted by a mounting flange 99.

Integral to the fan duct 93 and the heat sink flange 95, 95 are a plurality of fins 113, 113.

The fan assembly 131 of FIGS. 13 and 14 comprise all of the elements of the fan sub-assembly 91 of FIGS. 11 and 12, and further comprises a shroud 129. The shroud 129 comprises a front cover 115, a rear cover 117 and four side covers 119, 121, 123, 125 (hidden, on the far surface). The shroud 129 mostly blocks the outlet 127 of the fan 97, capturing a large part of the axial air flow, redirecting it back within the fan assembly 131 over the plurality of fins 113, 113 and back to the inlet of the fan. The inside of the fan duct 93 may or may not have special features to enhance heat flow.

Among the criteria used to determine the selection of a fan for fan and heat sink assemblies are two considerations:

One consideration is the mass of air that must be moved to transport the waste heat from the heat sink assembly. This is a factor of the specific heat of the air, the acceptable air temperature rise and the quantity of heat to be removed. Often, a modest exchange of air is sufficient to accomplish this. Another consideration is the velocity of air passing over the heat sink assembly needed to have satisfactory heat transfer from the surface of the heat sink through the boundary layer into the air stream. This is a factor of the surface area of the heat sink, the acceptable temperature rise of the heat sink and the quantity of heat to be removed. Often, the amount of air that must be moved to transport the heat away from the heat sink assembly is small compared to the amount of air that must be moved to sustain the requisite air velocity over the heat sink assembly.

In the fan assembly 131 of FIG. 13, the fan outlet 127 in the shroud 129 can be sized so that the exit air is only that mass of air which is necessary to transport the waste heat away from the assembly. The rest of the air can be recirculated within the fan assemble 131, with a velocity far higher than would usually be practical with separately mounted fan and heat sink assemblies. Not only does this fan assembly 131 take advantage of the improved heat transfer in the vicinity of the blade tips of the fan 97 but it also integrates additional heat sink features and completely contains the high velocity air stream. This will result in a compact, light weight self contained fan and heat sink assembly which also will be very quiet.

The outlet 127 of the shroud end cap 115 is preferably formed to extend inward nearly to the face of the fan 97. The inlet (not visible) in the shroud end cap 117 can be similarly formed. This has the effect of capturing most of the air flow and pressure of the fan 97, the remaining exit air being mostly from the blade roots. The air passages between the fins 113, 113 and the general shape and arrangement of the air flow path can be optimized with the fan 97 design to provide the correct back pressure for the fan for optimum fan performance to maximize the internal air flow. If necessary for the outlet pressure to be maintained, the outlet 127 can be made smaller or other wise restricted with baffles, aperture plates or whatever.

Often it is necessary to provide accessories on the inlet an/or outlet of a fan assembly, such as finger guards, EMI filters, particulate filters, acoustic noise filters and so forth. In the fan assembly 131 of FIGS. 13 and 14, the air flow entering and exiting the fan assembly 131 is much reduced so the accessories can be designed for the much reduced net air flow. This will allow them to be smaller, simpler and more effective.

The fan assembly 131 can be designed so that more or less air is recirculated and less or more air is carried through the fan assembly 131. This is a design trade off which would be understood by one skilled in the art. For some applications, the flow may be almost entirely internalized. For others, there may need to be significant air flow for other components, so more of the characteristics of a conventional axial flow fan may be retained by recirculating less air.

Figure 16:
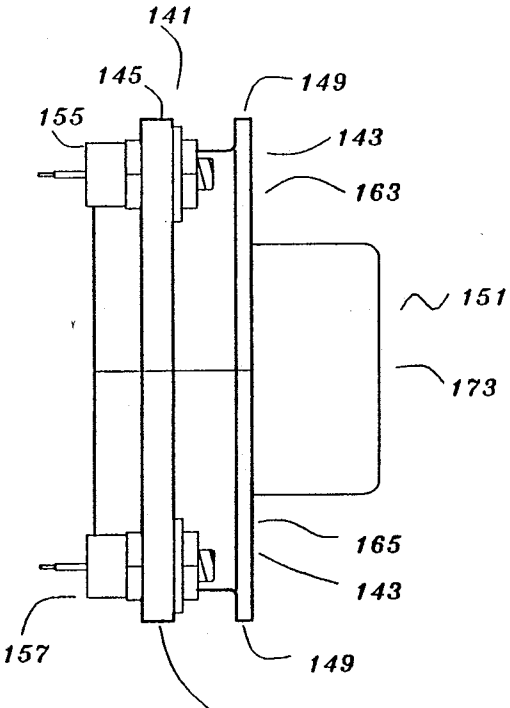
FIG. 16 shows the side view of the fan of FIG. 15.
Figure 15:
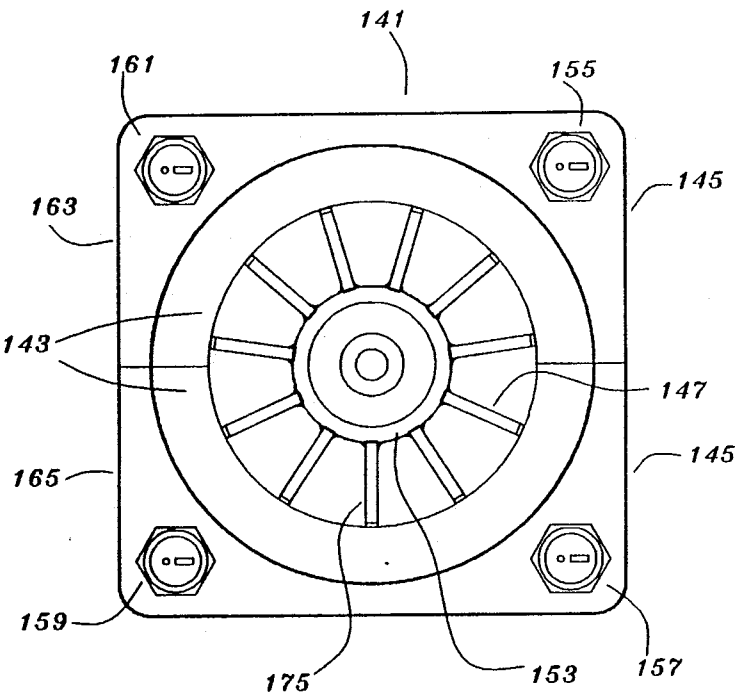
FIG. 15 shows a fan assembly having a heat sink mounting flange for semi-conductors. The impeller has straight blades providing no axial flow component, and only the front side is open, so no axial flow is provided.
Figure 17:
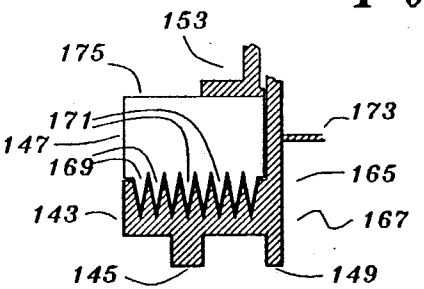
FIG. 17 shows a section through the fan duct and a side view of one of the impeller blades. The fan duct has deep grooves, to provide an increased surface for heat transfer. The impeller blades have complementary teeth extending into the grooves. Centrifugal forces will force air radially into the grooves, where it will circulate around at high velocity. A portion of the air will spill out around the periphery.

FIGS. 15 through 17 show another embodiment of the invention. FIG. 15 shows a front view of a fan assembly 141. A fan 147 rotates within a fan duct 143, 143. Integral to the fan duct 143, 143 is a heat sink mounting flange 145, 145 for mounting semiconductors 155, 157, 159 161. FIG. 16 shows a side view of the fan assembly 141. A motor 151 (hidden) inside the motor cover 173 drives the fan 147. The fan assembly 141 may be mounted by the mounting flange 149, 149. FIG. 17 shows a section 167 through the fan duct 143 and the fan hub 153, and also shows a side view of one of the blades 175 of the fan 147.

The inside surface of the fan duct 143 has deep grooves 169, 169 therein, to provide a greater surface area to enhance heat transfer. The fan blade 175 has complementary teeth 171, 171 extending into the grooves 169, 169. Because the complementary teeth 171, 171 extend to a larger diameter than the opening in the fan duct 143, 143, the fan duct 143, 143, the integrated heat sink flange 145, 145 and the mounting flange 149, 149 may be made as a first part 163 and a second part 165 which are joined at assembly.

The fan assembly 141 has no axial flow whatever, and in fact the section 167 shows that the back of the fan assembly 141 is closed. This is not a necessary condition, it could be open or partially open, but the point is made that axial flow is not necessary for the operation of the invention. In operation, the fan 147 tends to act as a centrifugal fan, drawing air in at the center of the fan hub 153 and forcing it outward. The air will tend to exit the fan 147 tangentially, but it cannot continue in that direction, so it will flow around within the grooves 171, 171 and spill out of the opening of the fan duct 143, 143. A portion of the air will then be drawn back in, recirculating within the fan assembly 141 while the rest will mix with the surrounding air and be dissipated.

The deep grooves 169, 169 provide a large surface area from which heat can flow into the air stream, and the complementary teeth 171, 171 on the fan 147 penetrate deeply into the grooves 169, 169 to sweep the air around at maximum velocity, clear out any air that might otherwise stagnate deep in the grooves 169, 169, and further maximally agitate the air through the activity of blade tip vortices and wake turbulence.

Figure 19:
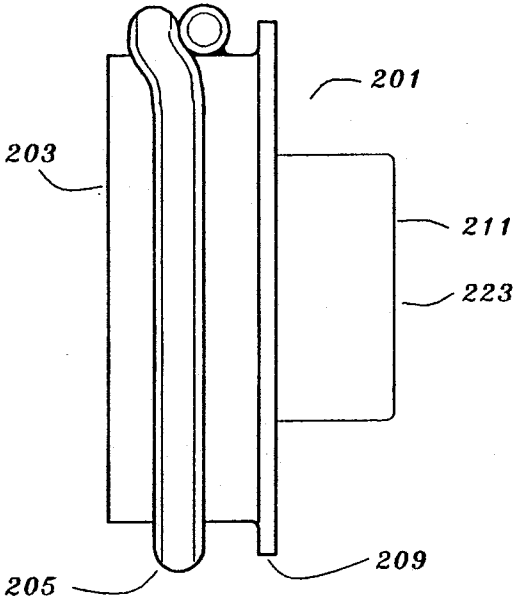
FIG. 19 shows a side view of the fan of FIG. 18.
Figure 18:
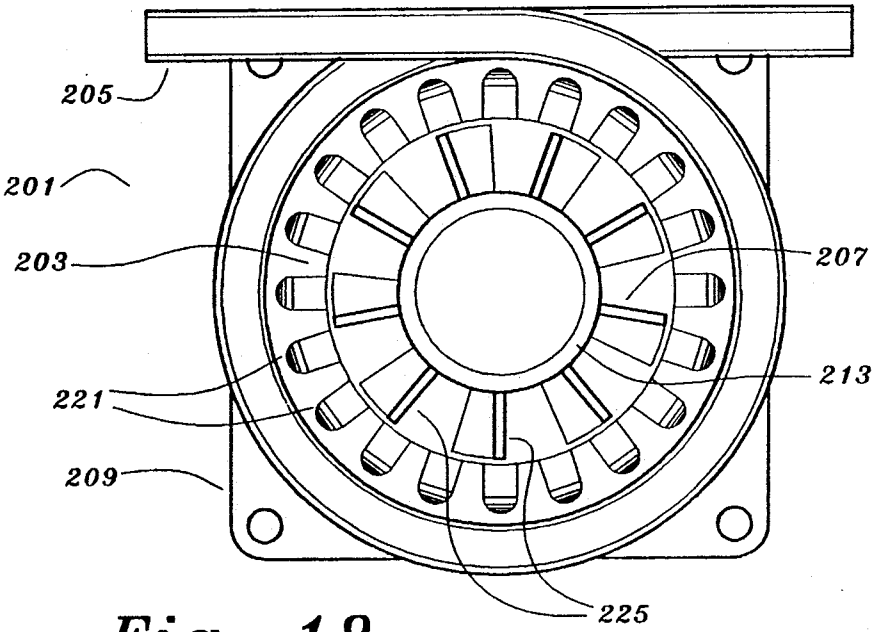
FIG. 18 shows a fan assembly having a conduit for a fluid. The impeller has blades with a slight twist to provide a small axial flow component, but only the front side is open, so no axial flow is provided. The duct has circumferential grooves to increase the area for heat transfer. The grooves may be spiralled as shown, to direct the air flow to have an axial component. As shown, the bias of the impeller urges air into the fan and the bias of the grooves in the duct urges air back out of the fan on the same side. Some will spill away, and some will be recirculated.

FIGS. 18 through 21 show another embodiment of the invention. FIG. 18 shows a front view of a fan assembly 201. FIG. 19 shows a side view of the same fan assembly 201. A fan 207 rotates in a fan duct 203. A fluid conduit 205 is wrapped around the fan duct 203 and preferably is bonded to it with a bonding means having good thermal conductivity such as braze or solder. The fan 207 may be driven by a motor 211 (hidden) within motor cover 223. A mounting flange 209 may be used to mount the fan assembly 201.

Figure 21:
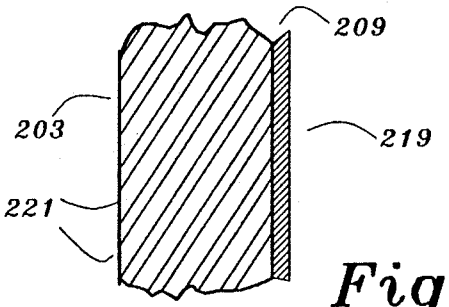
FIG. 21 shows a view from the inside of the fan duct showing a segment of the inside surface of the fan duct. The grooves are in a spiral to urge air flow back out of the fan.
Figure 20:
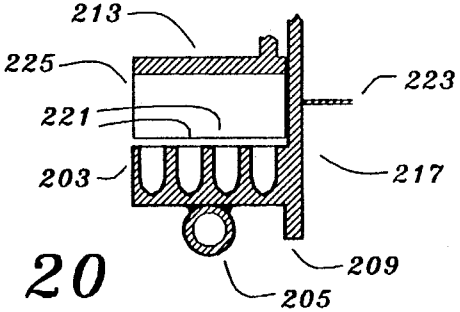
FIG. 20 shows a section through the fan duct and a side view of one of the impeller blades.

FIG. 20 shows a section 217 through the fan duct 203, the fluid conduit 205, the mounting flange 209 and the fan hub 213, and also shows a side view of a fan blade 225. The fan duct 203 contains a plurality of deep grooves 221, 221. FIG. 21 shows a segment 219 of the inside surface of the fan duct 203. The plurality of deep grooves 221, 221 can be seen, as can a section of the mounting flange 209.

Fluid having a temperature higher or lower than the ambient air can be circulated in the fluid conduit 205. Heat will flow from the fluid conduit 205 into the fan duct 203 and then into the air stream, or vice versa. The deep grooves 221, 221 in the inside surface of the fan duct 203 provide enhanced heat flow from the fan duct 203 to the air stream due to the increase surface area of the inside surface of the fan duct 203 and due to the high velocity air from the fan 207 which will circulate within the deep grooves 221, 221.

The deep grooves 221, 221 may be circular, or may have a spiral bias as shown in FIG. 21. If spiraled, the deep grooves 221, 221 could be one continuous groove, having one opening, or it could be a number of parallel grooves as shown. The spiral grooves 221, 221 could be biased in either direction, giving the exiting air an axial component of flow. As shown in FIG. 21, the deep grooves 221, 221 can be blocked on one end by the wall of the mounting flange 209, so the fan assembly 201 as a whole as shown has no possible axial air flow.

The fan blades 225, 225 are nearly straight, and could be straight. As shown, the fan blades 225, 225 have a slight twist, which would cause the air flow to have a slight axial flow component into the fan assembly 201 for counter clockwise rotation, but the primary air flow is outward, due to centrifugal force. The air would tend to leave the fan 207 tangentially, but it is captured and constrained by the deep grooves 221, 221 in the fan duct 203. As shown, the fan assembly 201 has no axial air flow outside of the fan assembly 201, and within the fan assembly 201, air is drawn in at the center of the fan hub 213 and given a slight axial component to draw the air deeper into the fan assembly 201. Once the air passes into the deep grooves 221, 221 it circulates circumferentially within the deep grooves 221, 221 and back out of the fan assembly 201. Some of the air will be drawn back into the fan assembly 201, and some of it will mix with the surrounding air and be dissipated. A partial baffle on the open side of the fan assembly could be used to increase the amount of recirculation of the air.

An alternative embodiment of the fan assembly 201 of FIGS. 18 through 21 could be made by reversing the spiral bias of the deep grooves 221, 221 in the fan duct 203 and further by providing exit openings through the mounting flange 209. When so modified, the fan assembly would have axial air flow, which could be useful in some applications.

Figure 22:
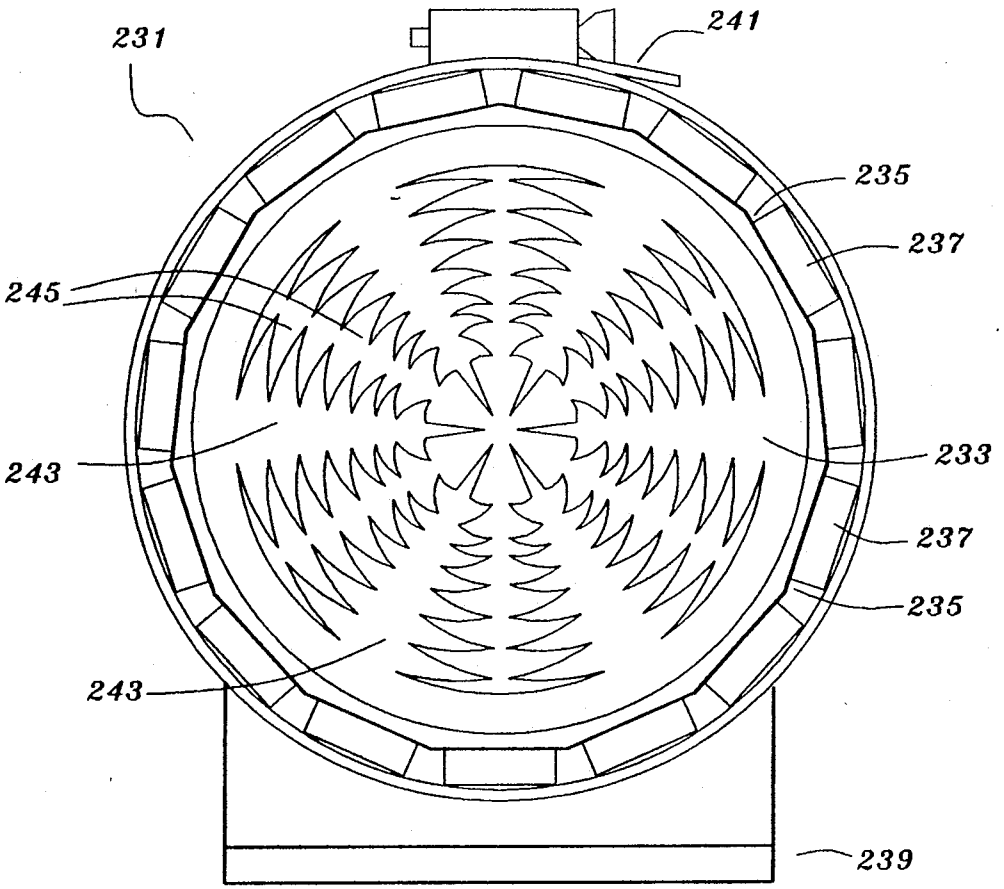
FIG. 22 shows the end view of a fan assembly having heat transfer fins integral with an outlet air flow straightener. A number of devices are heat sunk on the outside surface of the fan duct, and are clamped against the flat mounting surfaces with a ring clamp.
Figure 23:
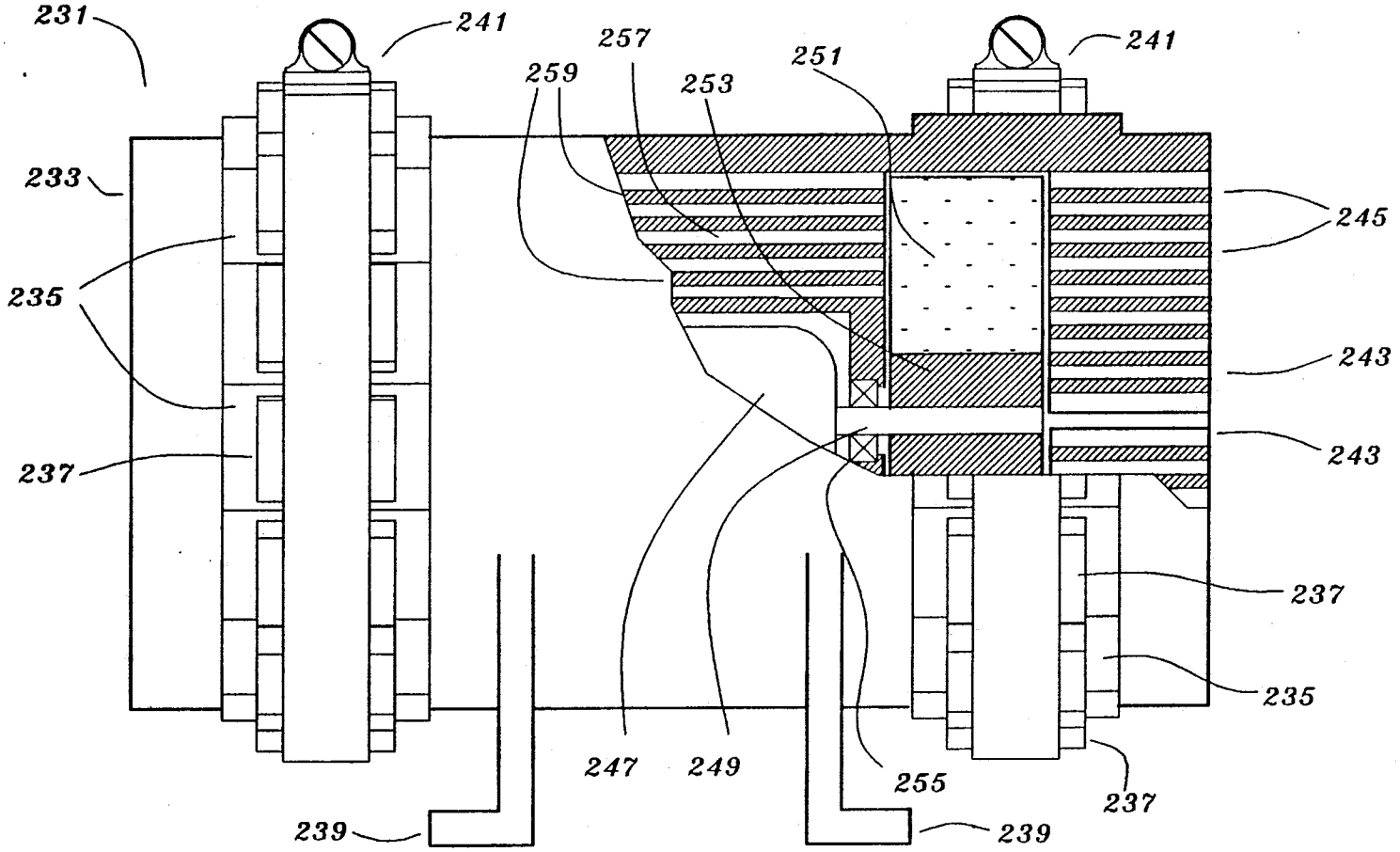
FIG. 23 shows a side view and partial section through the fan assembly of FIG. 22. The fan is a multi-stage fan, and the inlet and outlet have flow straighteners which are optimized for heat transfer. The flow directing baffles between the fan stages is also optimized for heat transfer.

FIGS. 22 and 23 show an end view and a side view with a partial cut-away of another embodiment of the invention. A fan assembly 231 has a plurality of heat sink flat surface areas 235, 235 for mounting devices 237, 237 which need heat sinking. Screw-tightened band clamps 241, 241 hold the devices 237, 237 tightly against the heat sink flat surface areas 235, 235. The fan assembly 231 may be mounted by feet 239, 239.

The ends of the fan assembly 231 may be similar in appearance, one being the air inlet and the other the air outlet. A plurality of heat conductive fins 243, 243 extend from the edge of the fan duct 233 into the air stream on both the inlet and the outlet ends of the fan assembly 231. The heat conductive fins 243, 243 may have smaller branch fins 245, 245 to further increase their surface areas and enhance heat transfer. The heat conductive fins 243, 243 have a low impedance thermal path to the heat sink flat surface areas 235, 235. Vane axial fans often have inlet and/or exit vanes to straighten the air flow, eliminating the vortices and improving fan performance. The heat conductive fins 243, 243 may perform the same function in the fan assembly 231, but in their design they may be optimized for heat transfer rather than fan performance. In FIG. 23 the section through the heat conductive fin 243 is forward of the center line to show the section through the smaller branch fins 245, 245.

A motor 247 turns a shaft 249 which drives a fan 251. The shaft 249 may have bearings 255, and the fan may have a hub 253. There may be another fan (or several) in the fan assembly 231 in the end which is not sectioned. In a multi-stage fan, whether it is a vane axial fan or a centrifugal fan, there are usually air directing vanes or baffles between the fans to straighten the air flow or redirect it as needed for the best performance of the fan assembly as a whole. In the fan assembly 231 of FIG. 23, the intermediate air directing baffles 257 may have a number of small branch fins 259, 259 to conduct heat into the air stream. While the air directing baffles 257 may direct the air as in a multi-stage fan of conventional design, they may also be optimized for heat transfer rather than optimum fan performance.

Regardless of the heat transfer into the several fins and branch fins, an important contribution to the heat flow to the air stream is the high velocity and turbulent air movement on the inside surface of the fan duct 233 in the vicinity of the blade tips of the fan 251. The inside surface of the fan duct 233 may incorporate features to enhance the heat flow, and the fan 251 may incorporate features to increase the velocity and turbulence of the air at the inside surface of the fan duct 233. The fan assembly may incorporate recirculation of a part of the air around one or both of the fans. The various fins and air passages may be optimized to provide back pressure for improved fan performance.

While many devices operate best and perform more reliably when cooled to the extent practical, other devices such as Schottky rectifier are more efficient at a higher temperature but none the less must be kept below a maximum temperature limit. Other devices, such as certain ferrites or ceramic capacitors may have an optimum temperature for best operation even if a somewhat higher temperature is not destructive. In any of the fan assemblies of the forgoing discussions a temperature sensitive feed back mechanism may be used to control the speed of the motor driving the fan. The fan can be driven more slowly if the temperature of the heat sink is less than optimum to allow the heat sink temperature to increase. As the optimum temperature is reached, the fan may operate at a faster speed to maintain the optimum temperature. The control could be linear, increasing the speed as the temperature increased, or it could be step-wise, for instance having a slow speed and a high speed.

In the foregoing discussions.and the claims, "air" and "air stream" are used in a generic sense to mean a heat transporting fluid. The teachings of the invention would apply equally to any similar mechanism employing any fluid for heat transfer, compressible or incompressible. Likewise, "heat sink", "heat sinking" and "heat transfer into the air stream" are used in a generic sense (as that is the more common application), but heat transfer in either direction is contemplated by the invention and is equally applicable. In the foregoing discussions and the claims, "integral with" and "integral to" are not restricted to one piece items made from a single piece of material but also includes separate parts which are joined together by any means into an assembly such as by bonding, gluing, clamping, screwing, brazing, soldering, and so forth, the resulting assembly having good thermal contact and a low impedance thermal path between the parts thereof.

I claim:

1. A fan assembly with heat sink comprising:

a fan having a plurality of fan blades, means for rotating the fan so that air is moved through the fan assembly with heat sink, a fan duct having a wall with an inside and outside surface surrounding the fan, the fan rotating within the fan duct with the plurality of fan blades of the fan proximate to the inside surface of the fan duct, and at least one heat sink mounting surface integral to the fan duct for mounting a device to be cooled or heated, the heat further being conducted from the fan duct to the air which is moved through the fan assembly with heat sink, whereby the conduction of heat is enhanced by the high velocity and turbulence of the air in the vicinity of the plurality of fan blades of the fan, and is further enhanced by textural features which increase the surface area of the inside surface of the fan duct proximate to the fan blades of the fan.

2. The fan assembly with heat sink of claim 1 wherein the textural features on the inside surface of the fan duct comprise a plurality of circumferential grooves and ridges.

3. The fan assembly with heat sink of claim 1 wherein the textural features on the inside surface of the fan duct comprise a plurality of posts.

4. The fan assembly with heat sink of claim 1 wherein the textural features on the inside surface of the fan duct comprise a plurality of thin fins.

5. The fan assembly with heat sink of claim 1 wherein the textural features on the inside surface of the fan duct comprise a plurality of holes from the inside of the fan duct in the vicinity of the fan blades of the fan to the outside of the fan duct, whereby the inside surface of the fan duct is increased, and whereby air bleeds through the plurality of holes, further enhancing the conduction of heat from the fan duct to the air which is moved through the fan assembly with heat sink.

6. The fan assembly with heat sink of claim 5 wherein the plurality of holes from the inside of the fan duct in the vicinity of the fan blades of the fan to the outside of the fan duct are tangential to the rotation of the fan.

7. The fan assembly with heat sink of claim 1 wherein the fan blades further comprise a plurality of paddle bars, the plurality of paddle bars being generally transverse to the rotation of the fan, the plurality of paddle bars further being proximate to and generally parallel to the inside surface of the fan duct.

8. The fan assembly with heat sink of claim 7 wherein the textural features on the inside surface of the fan duct comprise a plurality of deep grooves which are circumferential to the inside of the fan duct.

9. The fan assembly with heat sink of claim 8 wherein the paddle bars further comprise a plurality of teeth which extend radially from the paddle bars into the plurality of deep grooves, whereby the plurality of teeth extending radially from the paddle bars into the plurality of deep grooves further increases the turbulence of the air in the vicinity of the plurality of deep grooves and thus enhances heat flow from the air duct to the air moving through the fan assembly with heat sink.

10. The fan assembly with heat sink of claim 1 wherein the at least one device to be cooled or heated comprises a conduit for a fluid, whereby heat can be transferred from the fluid through the at least one heat sink mounting surface into the fan duct and then into the air moving through the fan assembly with heat sink.

* * * * *